US005108560A

United States Patent [19]

Cawlfield et al.

[11] Patent Number: 5,108,560

[45] Date of Patent: * Apr. 28, 1992

[54] ELECTROCHEMICAL PROCESS FOR PRODUCTION OF CHLORIC ACID FROM HYPOCHLOROUS ACID

[75] Inventors: David W. Cawlfield; Ronald L. Dotson; Sudhir K. Mendiratta, all of Cleveland; Budd L. Duncan, McMinn; Kenneth E. Woodard, Jr., Cleveland, all of Tenn.

[73] Assignee: Olin Corporation, Cheshire, Conn.

[ * ] Notice: The portion of the term of this patent subsequent to Nov. 12, 2008 has been disclaimed.

[21] Appl. No.: 581,812

[22] Filed: Sep. 13, 1990

Related U.S. Application Data

[63] Continuation-in-part of Ser. No. 502,150, Mar. 30, 1990, abandoned.

[51] Int. Cl.[5] ..... C25B 1/22

[52] U.S. Cl. ..... 204/103; 204/290 R; 204/292; 204/290 F

[58] Field of Search ..... 204/59 R, 103, 129

[56] References Cited

U.S. PATENT DOCUMENTS

| | | | |
|---|---|---|---|
| 2,163,793 | 6/1937 | Logan | 204/9 |
| 2,717,237 | 9/1955 | Rempel | 204/101 |
| 3,763,006 | 10/1973 | Callerame | 204/103 |
| 3,810,969 | 5/1974 | Schlumberger | 423/478 |
| 3,904,496 | 9/1975 | Harke et al. | 204/98 |
| 3,995,016 | 11/1976 | Kittle | 423/500 |
| 4,146,578 | 3/1979 | Brennan et al. | 423/473 |
| 4,469,576 | 9/1984 | Akazawa et al. | 204/269 |
| 4,542,008 | 9/1985 | Capuano et al. | 423/477 |
| 4,798,715 | 1/1989 | Hardee et al. | 423/478 |

FOREIGN PATENT DOCUMENTS

| | | |
|---|---|---|
| 158883 | 7/1981 | Japan . |
| 001866 | 10/1988 | Japan . |

OTHER PUBLICATIONS

The Condensed Chemical Dictionary "Hypochlorous Acid" Eighth Edition.

*Primary Examiner*—John Niebling
*Assistant Examiner*—Kathryn Gorgos
*Attorney, Agent, or Firm*—Allen A. Meyer, Jr.; Paul Weinstein

[57] ABSTRACT

A process for producing chloric acid in an electrolytic cell having an anode and a cathode which includes feeding an aqueous solution of hypochlorous acid to the electrolytic cell, and electrolyzing the aqueous solution of hypochlorous solution to produce a chloric acid solution. Using the process of the invention, chloric acid can be produced efficiently at substantially reduced production costs using a process which can be operated commercially. In addition, the chloric acid solutions produced are of high purity and are stable at ambient conditions.

12 Claims, 1 Drawing Sheet

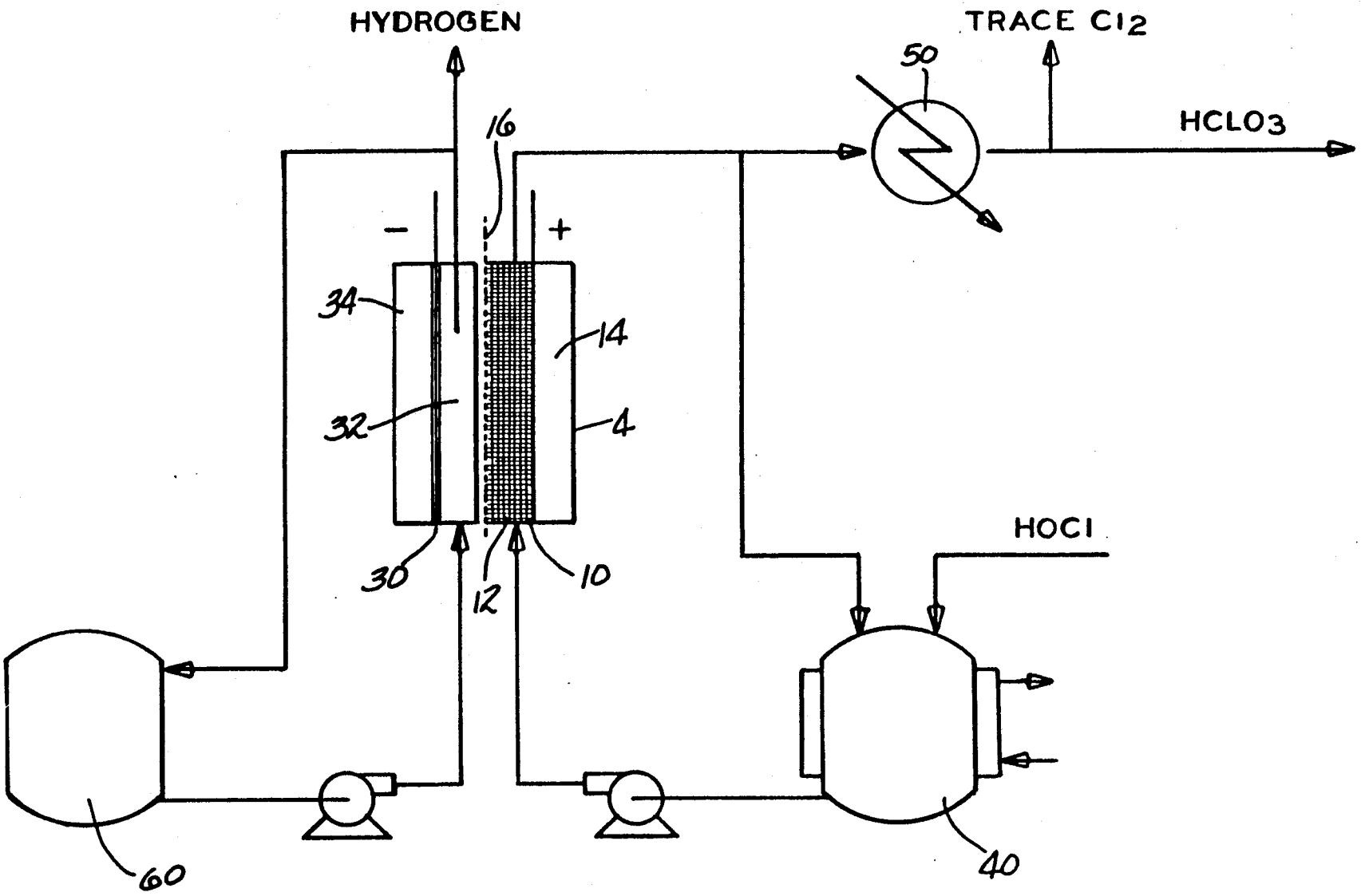
HCLO3
TRACE Cl2
50
HOCl
40
14
4
10
+
16
12
HYDROGEN
−
34
32
30
60

ELECTROCHEMICAL PROCESS FOR PRODUCTION OF CHLORIC ACID FROM HYPOCHLOROUS ACID

This application is a continuation in part application of Ser. No. 502,150 filed Mar. 30, 1990 now abandoned.

BACKGROUND OF THE INVENTION

This invention relates to the production of chloric acid, $HClO_3$. Chloric acid can be used in the formation of chlorine dioxide, a commercial bleaching and sanitizing agent.

Chloric acid is a known compound which has been made in laboratory preparations by the reaction of barium chlorate with sulfuric acid to precipitate barium sulfate and produce a dilute aqueous solution of chloric acid which was concentrated by evaporation of water under partial vacuum. In another method, sodium chlorate is reacted with an acid such as hydrochloric acid or sulfuric acid to produce an aqueous solution of chloric acid containing sulfate or chloride ions as impurities. In addition, commercial processes for producing chlorine dioxide form chloric acid as an intermediate.

U.S. Pat. No. 3,810,969 issued May 14, 1974 to A. A. Schlumberger teaches a process for producing chloric acid of high purity by passing an aqueous solution containing from 0.2 gram mole to 11 gram moles per liter of an alkali metal chlorate such as sodium chlorate through a selected cationic exchange resin at a temperature from 5° to 40° C. The process produces an aqueous solution containing from 0.2 gram mole to about 4.0 gram moles of $HClO_3$.

Chloric acid, however, up to the present time, has not been produced or available commercially because of the high manufacturing costs and/cr the undesired impurities present in the solutions of $HClO_3$ made by these reactions.

SUMMARY OF THE INVENTION

Now it has been found that chloric acid can be produced efficiently at substantially reduced production costs using a process which can be operated commercially. In addition, the chloric acid solutions produced are of high purity and are stable at ambient conditions.

In accordance with this invention, there is provided a process for the production of chloric acid in high concentrations and substantially free of impurities such as alkali metal ions, chloride ions and sulfate ions.

The process of the invention produces chloric acid in an electrolytic cell having an anode and a cathode; the process comprises feeding an aqueous solution of hypochlorous acid to the electrolytic cell, and electrolyzing the aqueous solution of hypochlorous acid solution to produce a chloric acid solution.

In a preferred embodiment of the process, chloric acid is produced in an electrolytic cell having an anode compartment, a cathode compartment, and an cation exchange membrane separating the anode chamber from the cathode chamber, the process comprises feeding an aqueous solution of hypochlorous acid to the anode chamber, and electrolyzing the aqueous solution of hypochlorous acid solution to produce a chloric acid solution.

DETAILED DESCRIPTION OF THE INVENTION

The process is represented by the following equation:

$$HOCl + 2H_2O \rightarrow HClO_3 + 2H_2 + 4e \quad (1)$$

The novel process of the present invention employs as the starting material a concentrated solution of hypochlorous acid, HOCl. One method of producing high purity concentrated HOCl solutions is that in which gaseous mixtures, having high concentrations of hypochlorous acid vapors and chlorine monoxide gas and controlled amounts of water vapor are produced, for example, by the process described by J. P. Brennan et al in U.S. Pat. No. 4,147,761, which is incorporated in its entirety by reference. The gaseous mixture is then converted to a concentrated hypochlorous acid solution. An additional process for producing high purity HOCl solutions is that in which gaseous chlorine monoxide is dissolved in deionized water.

While the hypochlorous acid solution employed as the anolyte may be of any concentration, for practical reasons, it is preferred to employ solutions which contain concentrations of from about 5 to about 60, and more Preferably from about 5 to about 35 percent by weight of HOCl. The solution is substantially free of ionic impurities such as chloride ions and alkali metal ions as well as metal ions such as nickel and copper, among others.

BRIEF DESCRIPTION OF THE DRAWINGS

The process of the invention is shown by the FIGURE which is a diagrammatic illustration of a system which can be employed.

The FIGURE shows an electrolytic cell 4 divided into anode compartment 10 and cathode compartment 30 by cation permeable ion exchange membrane 16. Anode compartment 10 includes anode 12, and anode chamber 14 behind anode 12 for circulation of a coolant. Cathode compartment 30 includes cathode 32, and cathode chamber 34 which aids in the disengagement of any catholyte gas produced. The hypochlorite acid solution is pumped from container 40 to anode compartment 10 of electrolytic cell 4. Following electrolysis, the chloric acid solution produced is removed and passed through heat exchanger 50, and recovered. Spent catholyte from cathode compartment 30 is removed and returned to container 60.

During cell operation, current densities employed include those in the range of from about 1 to about 10, and preferably from about 2 to about 6 $KA/m_2$.

Electrolytic cell designs for use in operating the process of the invention are those which minimize the anode-cathode gap to reduce electrical resistance. The anode to membrane gap is maintained as narrow as possible but should be wide enough to prevent actual contact during cell operation. Maintenance of the anode membrane gap can be accomplished, for example, by operating the cell with a higher pressure in the anolyte than the catholyte, or by placing a fine non-conductive porous spacer between the anode and the membrane. Suitable anode materials must be stable in an acidic and oxidative media. Examples of suitable anode material include platinum group metals, platinum group metal coated substrates, glassy carbon, fluorinated carbons, lead dioxide, noble metal oxides, and substrates coated with noble metal oxides.

The anode structure is preferably porous being formed, for example, of a coated wire cloth or expanded mesh in a structure which allows the anolyte to flow in all three dimensions and promotes turbulence near the anode surface. Materials which can be employed in the anode structures include platinum and platinum group metals, metal substrates coated with platinum or platinum group metals, lead dioxide and metal substrates coated with lead dioxide Suitable metal substrates include valve metals such as titanium and niobium among others.

If the temperature of the anolyte is controlled by cooling in the anode chamber, the anode is attached for example, by welding, to a back plate which is electrically and thermally conductive. This back plate forms a wall of the anode chamber through which the coolant is circulated. Suitable coolants include water, alcohol solutions, and glycol solutions.

The cathode is preferably in contact with the ion exchange membrane to minimize interference of hydrogen gas produced on the cathode with ionic conduction of hydrogen ions through the membrane to the cathode. Any suitable materials which evolve hydrogen gas may be employed in the cathode such as stainless steel, nickel alloys, platinum group metals, metals plated with platinum group metals etc. The cathode material should be insoluble in the acidic catholyte media while under current load, and preferably insoluble without cathodic protection.

As the catholyte, any suitable electrolyte may be employed such as a mineral acid i.e., sulfuric acid, phosphoric acid, or hydrochloric acid , as well as chloric acid and/or perchloric acid. In one embodiment, the catholyte is a solid state acid such as a perfluorosulfonic acid resin (sold commercially by E. I. DuPont de Nemours & Company, Inc., under the trademark "NAFION"). When using a solid state acid as the catholyte, small amounts of hydrochloric acid are produced at the cathode.

The cation exchange membrane selected as a separator between the anode and cathode compartments is a chemically stable membrane which is substantially impervious to the hydrodynamic flow of the electrolytes and the passage of any gas products produced in the anode or cathode compartments.

Cation exchange membranes are well-known to contain fixed anionic groups that permit intrusion and exchange of cations, and exclude anions from an external source. Generally, the resinous membrane or diaphragm has as a matrix, a cross-linked polymer, to which are attached charged groups such as $-SO^-_3$. The resins which can be used to produce the membranes include, for example, fluorocarbons, vinyl compounds, polyolefins, hydrocarbons, and copolymers thereof. Preferred are cation exchange membranes such as those comprised of fluorocarbon polymers having a plurality of pendant sulfonic acid groups and/or phosphonic acid groups. The term "sulfonic acid group" is meant to include compounds of sulfonic acid which when hydrolyzed produce sulfonic acid such as sulfonyl chloride and sulfonyl fluoride. Similarly, the term "phosphonic acid group" is meant to include compounds which when hydrolyzed produce phosphonic acid.

The process is operated to minimize the residence time of the chloric acid solution in the anolyte system. This can be achieved, for example, by limiting the size of the anode compartment with respect to width or length, etc. Residence times which are satisfactory are those which minimize decomposition of the hypochlorous acid by non-electrolytic reactions. Suitable residence times are typically less than about 8 hours, and preferably less than 2 hours.

During cell operation, the temperature of the chloric acid solution can be up to about 80° C., and preferably from about 40° to about 80°.

The chloric acid solution produced in the process of the invention includes mixtures of chloric acid and hypochlorous acid. Concentrated chloric acid solutions are produced, for example, by evaporation of a portion of the water. Any residual hypochlorous acid is decomposed during the concentration. Suitably the chloric acid solution is heated at temperatures above about 40° C., for example at temperatures in the range of from about 40° to about 120° C., preferably at from about 70° to about 120° C. and more preferably at from about 95° to about 120° C. It may be advantageous to employ a sealed reactor to decompose the hypochlorous acid at the autogenous pressures attained.

Optionally, a dilute chloric acid solution can be concentrated by vacuum distillation at any suitable vacuum pressures such as those in the range of from about 0.01 to about 100 mm Hg. pressure.

Chloric acid solutions can be produced by the novel process of the present invention in any concentrations desired up to about 45% by weight of $HClO_3$. However, for commercial applications, preferred concentrations are those in the range of from about 10 to about 40% by weight of $HClO_3$.

In one embodiment, a portion of the chloric acid solution produced is admixed with additional hypochlorous acid and the process operated continuously. This improves, for example, the conductivity of the anolyte.

The novel process of the present invention is further illustrated by the following examples with no intention of being limited thereby. All parts and percentages are by weight unless otherwise indicated.

EXAMPLE 1

An electrochemical cell of the type shown in FIG. 1 was employed having an anode compartment and a cathode compartment separated by a cation exchange membrane. The anode was formed from a platinum-clad niobium plate about 0.04" thick having an active surface area formed of a 10×10 square weave mesh. The anode was spot-welded under an inert helium blanket to a platinum-clad niobium plate and placed within an anode spacer to form the anode compartment. The anode compartment with the spacer was about ⅛ inch (0.3176 centimeters) wider than the anode, leaving a small gap adjacent the cation exchange membrane through which the anolyte was force circulated. The cathode was formed from a two layer Hastelloy ®C-22 mesh structure having a very fine outer 100 mesh screen layer supported on a coarse inner (6 wires per inch) mesh layer. The cathode was attached to a solid Hastelloy ®C-22 backplate by spot welding and was placed within a cathode spacer to form a cathode compartment. The cathode was in direct contact with the adjacent membrane in a zero-gap configuration. A cation permeable fluoropolymer based membrane, sold under the tradename Nafion ®117 by the E. I. duPont de Nemours & Company, separated the anode compartment from the cathode compartment. During cell operation, an aqueous solution of hypochlorous acid containing 25% by weight of HOCl was continuously fed to the anode compartment as the anolyte at a flow rate of about 0.5 ml/min.

The catholyte compartment was initially filled with deionized water. The deionized water was gradually acidified to a dilute hydrochloric acid of about 3% to about 5% concentration from the diffusion of a small amount of hypochlorous acid and/or chlorine gas from the anolyte compartment through the membrane. Since some water is also transported through the membrane with H+ ions from the anolyte compartment to the catholyte compartment, excess catholyte was generated and was removed from the catholyte chamber by the rising action of the hydrogen and small amount of chlorine gas exiting out the top of the cathode into a catholyte gas-liquid disengager. The water transporting through the membrane obviates the need for adding further deionized water to the catholyte compartment after the initial fill.

After the initial startup, the cell was operated at a current of 7.5 amps which was gradually increased to a final current of 10 amps. The cell voltage was in the range of from 2.975 to 3.340 volts. Under these operating conditions, the concentration of chloric acid in the catholyte increased to 22.691% by weight of $HClO_3$ and the HOCl concentration decreased to 0.799% by weight. Gases produced in the anolyte chamber were scrubbed in an aqueous solution of 10% potassium iodide. The cell was operated for about twenty hours.

EXAMPLE 2

The electrolytic cell of Example 1 had the anode replaced with an anode formed from a platinum clad niobium plate with platinum clad mesh of the same size as in Example 1, but with a lead oxide coating. The cell was operated for about eleven and one-half hours by continuously feeding as the anolyte an aqueous solution of hypochlorous acid containing 15% by weight of HOCl. The cell operation was interrupted after about five and one-half hours and then restarted after about a sixteen and one-half hour interruption. The anolyte feed rate was maintained at 0.77–0.78 ml/min during the periods of operation. Employing currents in the range of from 5.0 to 7.5 amps, the cell voltage was in the range of 2.801 to 3.022 volts.

Chloric acid concentrations produced in the anolyte were in the range of from 8.812 to 10.406% by weight, with the concentration of HOCl being in the range of from 1.965 to 3.242% by weight after the first three hours of operation.

EXAMPLE 3

The electrolytic cell of Example 2 was employed with the same platinum cladding layer on the anode coated with lead oxide. The anolyte solution, an aqueous solution of hypochlorous acid containing about 15% by weight of HOCl, was continuously fed to the anode chamber at a rate maintained at about 0.77–0.78 ml/min. After startup, the cell current was maintained in the range of about 6.0 to about 7.1 amps and the cell voltage varied from about 2.685 to about 2.789 volts. The cell was operated for about 4 hours before operation was interrupted for about 17 hours and then resumed for an additional 4.5 hours.

Chloric acid concentrations produced in the anolyte were in the range of from about 5.961 to about 8.376% by weight, with the concentration of HOCl being in the range of from about 5.635 to about 8.211% by weight after the first three hours of operation.

EXAMPLE 4

The electrolytic cell of Example 1 was employed, except that the anode was formed from a porous felt metal structure of titanium metal ribbons coated with platinum metal. After startup, the cell current was maintained at about 7.0 amps and cell voltages varied from about 2.750 to about 2.792 volts during about 7 hours of continuous operation.

Chloric acid was produced at a concentration in the range of from about 9.596 to about 11.547% by weight with the hypochlorous acid concentration being maintained at about 2.747 to about 3.014% by weight. The yield of chloric acid was in the range of about 38.9 to about 48% at HOCl conversions of from about 81.1 to about 85.0%. Current efficiencies were in the range of from about 62.1 to about 74.1%.

EXAMPLE 5

The electrolytic cell of Example 4 was operated for about 13 hours with one approximately 16 hour interruption after the first 6.5 hours of operation using an aqueous solution of hypochlorous acid containing about 20% by weight of HOCl as the anolyte. After startup, the cell current was maintained in the range of about 7.0 to about 8.2 amps and cell voltages varied from about 2.662 to about 2.831. The yield of chloric acid having concentrations in the range of about 12.373 to about 17.208% by weight was from about 36.8 to about 47.2 percent. The HOCl conversions of to $HClO_3$ ranged from about 71.2 to about 90.3%. Current efficiencies of about 62.1 to about 74.1% were achieved.

The concentrations of chloric acid produced were in the range of from about 12.275 to about 17.208% by weight at yields of about 28.2 to about 47.2% at conversions of about 95.3 to about 100%.

What is claimed is:

1. A process for producing chloric acid in an electrolytic cell having an anode compartment, a cathode compartment and an ion exchange membrane separating the anode compartment from the cathode compartment which comprises:

(a) feeding an aqueous solution of hypochlorous acid substantially free of ionic impurities to the anode compartment, and, (b) electrolyzing the aqueous solution of hypochlorous acid at a residence time of less than about 8 hours to produce a chloric acid solution.

2. The process of claim 1 accomplished by the current density during electrolysis being from about 1 to about 10 $KA/m^2$.

3. The process of claim 1 in which the chloric acid solution being a mixture of chloric acid and hypochlorous acid.

4. The process of claim 3 accomplished by heating the chloric acid solution to a temperature above about 40° C. to concentrate the chloric acid solution.

5. The process of claim 4 accomplished by maintaining the cell temperature at from about 40° to about 80° C.

6. The process of claim 1 accomplished by admixing a portion of the chloric acid solution with the hypochlorous acid solution fed to the electrolytic cell.

7. The process of claim 1 accomplished by maintaining the residence time of the chloric acid solution in the anode compartment of less than about 2 hours.

8. The process of claim 1 accomplished by maintaining a cathode in the cathode compartment in contact with the ion exchange membrane.

9. The process of claim 1 in which the aqueous solution of hypochlorous acid has a concentration of from about 5 to about 60% by weight of HOCl.

10. The process of claim 1 accomplished by admixing a portion of the chloric acid product solution with the aqueous hypochlorous acid solution fed to the anode compartment.

11. The process of claim 1 accomplished by employing as an anode in the anode compartment a platinum group metal or metal substrates coated with a platinum group metal.

12. The process of claim 11 in which the metal substrate is a valve metal.

* * * * *